US005365666A

United States Patent [19]

Gonzalez

[11] Patent Number: 5,365,666

[45] Date of Patent: Nov. 22, 1994

[54] ERGONOMIC KNIFE STRUCTURE

[76] Inventor: René G. Gonzalez, 28294 Pierce St., Southfield, Mich. 48076

[21] Appl. No.: 192,897

[22] Filed: Feb. 7, 1994

[51] Int. Cl.[5] ..... B26B 3/00; B26B 9/00

[52] U.S. Cl. ..... 30/340; 7/167; D22/118; 30/342; 30/351

[58] Field of Search ..... 30/340, 342–344, 30/351, 294; 7/167; 16/110 R; 81/177.1; D7/649–651, 693, 696; D8/300; D22/118

[56] References Cited

U.S. PATENT DOCUMENTS

| | | | |
|---|---|---|---|
| D. 70,942 | 8/1926 | Brown | D22/118 |
| D. 298,211 | 10/1988 | Coburn | D22/118 |
| D. 344,006 | 2/1994 | Glesser | D22/118 |
| 1,967,479 | 7/1934 | Platts | 30/342 |
| 1,998,044 | 4/1935 | Brown | 30/342 |

OTHER PUBLICATIONS

Knives Illustrated Summer 1989 p. 65.

*Primary Examiner*—Douglas D. Watts
*Attorney, Agent, or Firm*—Peter A. Taucher; Gail S. Soderling

[57] ABSTRACT

An improved ergonomic knife configuration is disclosed. The knife has a blade with an unsharpened notch formed on the upper, back surface of the blade and a thrust ramp located approximately above the quillion. The knife also has a shaped handle which in combination with a choil and the notch allows the knife to be gripped in a variety of different grips for various uses.

3 Claims, 2 Drawing Sheets

ERGONOMIC KNIFE STRUCTURE

GOVERNMENT INTEREST

The invention described herein may be manufactured, used and licensed by or for the Government for governmental purposes without payment to me of any royalty.

BACKGROUND OF THE INVENTION

1. Field of the Invention

This invention relates to knife structures.

2. Prior Art

There are various knife structures known in the art. The exact configuration of the blade and handle are usually dictated by the particular purpose for which the knife was designed. For instance, a fillet knife for fish would have a thin flexible single edged blade with a keen edge and a handle designed to facilitate control while exerting moderate lateral forces encountered when working with the knife. In contrast, a knife designed for combat would have a thicker rigid blade with a sturdy double edged point to provide penetration, the edge being far less keen and more durable and a grip designed to allow a firm grasp while exerting large axial forces, stabbing, and incorporating guards to protect the users hand from an opponents knife.

In general a knife's blade and handle are adapted to be employed in one or two manners, functions and amenable to being safely grasped in only one or two ways. It would be desirable to have a blade and handle structure which could be grasped in a variety of ways to perform tasks commonly performed by a variety of different knifes.

BRIEF SUMMARY OF THE INVENTION

Briefly, the present invention provides an improved ergonomic knife configuration which greatly increases its utility as a tool. The knife comprises a blade with a sharpened edge and an integral tang extending away from the sharpened edge. A quillion projects from the lower, sharpened blade portion near the midportion of the blade between the tang and the edge with a choil located juxtaposed the quillion, between the quillion and the sharpened edge. The blade has an unsharpened notch formed on the upper, back surface of the blade the unsharpened notch being located forward of the handle so as to be in a comfortable position for a users thumb when the users index finger is in the choil. A thrust ramp is located on the back of the blade approximately above the quillion at the beginning of the tang.

A handle is firmly attached to the tang, the handle including two shaped pieces one piece being mounted on each side of the tang, to form a handle suitable for gripping. The handle formed by the two pieces has a first recess located on the lower handle juxtaposed the quillion. A second recess is formed on the handle adjacent the first recess and a depression is formed on the top surface of the handle. The handle has a contoured pommel at its free end with a hook on the lower portion of the pommel to prevent slippage.

DETAILED DESCRIPTION OF PREFERRED EMBODIMENTS

Figure 1:
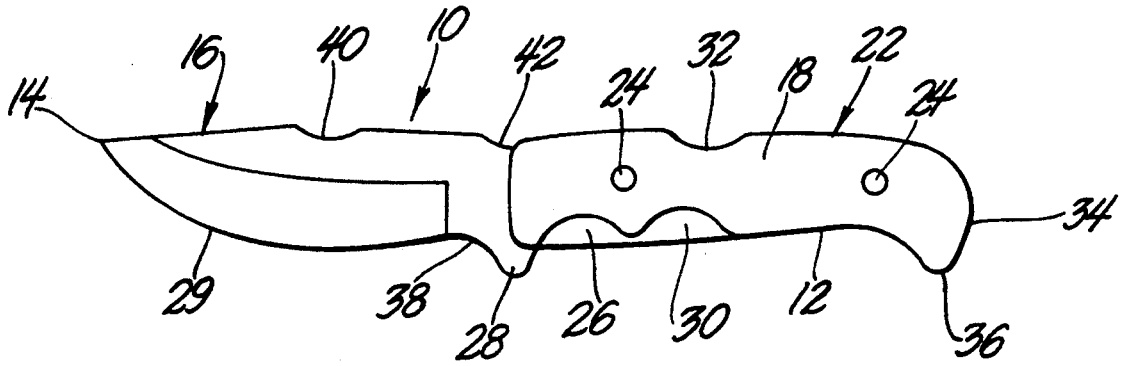
FIG. 1 is a front view of one embodiment of this invention.

In the accompanying drawing where like numbers refer to like parts, the knife of this invention will be described in detail and the various grasps which can be used because of its improved design detailed. Referring to the accompanying drawing and initially to FIGS. 1 and 2, broadly, the knife comprises a blade portion, designated generally 10, having a tang 12 extending away from the point 14 and edged portion 16 so as to provide a means for mounting two shaped pieces 18, 20 thereon to form a shaped handle 22 suitable for gripping. In the drawing, the shaped handle pieces 18, 20 are attached to the tang 12 by means of two rivets 24 such attachment being common in the art.

Although the handle is shown as two pieces fastened to the tang by rivets the handle could be formed as a single unitary structure enclosing the tang. Such structures can be formed by molding the handle about the tang. Also the handle could formed as a forged structure incorporating the tang providing a single piece handle. Both these production processes are known in the art and further description is omitted in the interest of brevity.

As shown the handle 22 has a first recess 26 located on both sides of the lower edge of handle 22 juxtaposed the area where the handle ends and adjacent a single rounded quillion, 28 located on the lower sharpened edge 29 of the blade 16. A second recess 30 is formed on the handle 22 adjacent the first recess 26. A depression 32 is formed on the top surface of the handle 22 behind the blade 16. The depression 32 is located about 1.5 to 2.5 inches behind the juncture of the blade 16 and the handle 22 the handle having a contoured pommel 34 at its free end with a hook 36 on the lower portion of the pommel to prevent slippage.

The blade portion 16 of the knife 10 has the quillion 28 mentioned before located on the lower sharpened portion 29 of the blade designed to act as a protection for a gripping hand, not shown. A choil 38, an unsharpened notch, is formed near the sharpened portion 29 of the blade juxtaposed the quillion 28. The remainder of the lower portion of the blade is honed with an edge to the terminus or point 14 of the blade 16. The blade 16 has an unsharpened notch 40 formed on the upper, back surface of the blade 16 the notch 40 being located forward of the handle 22 so as to be a comfortable position for a user's thumb when the users index finger is in the choil 38. A thrust ramp 42 is located approximately above the quillion 28 and near the juncture of handle 22 and blade 16.

Figure 2:
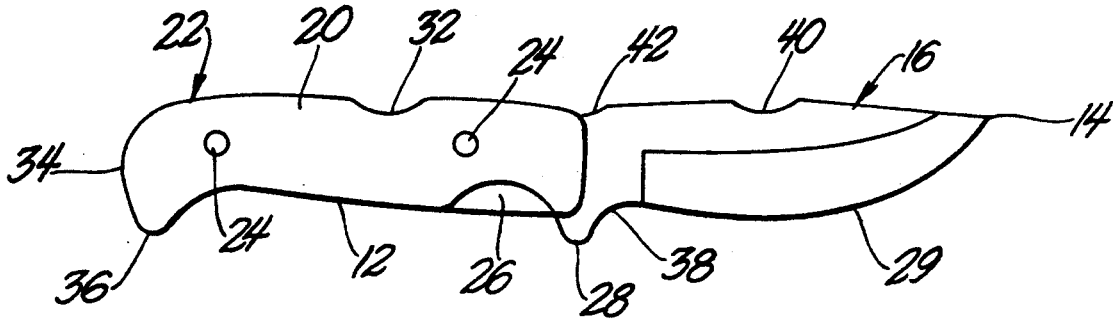
FIG. 2 is the back view of the knife of FIG. 1.
Figure 3:
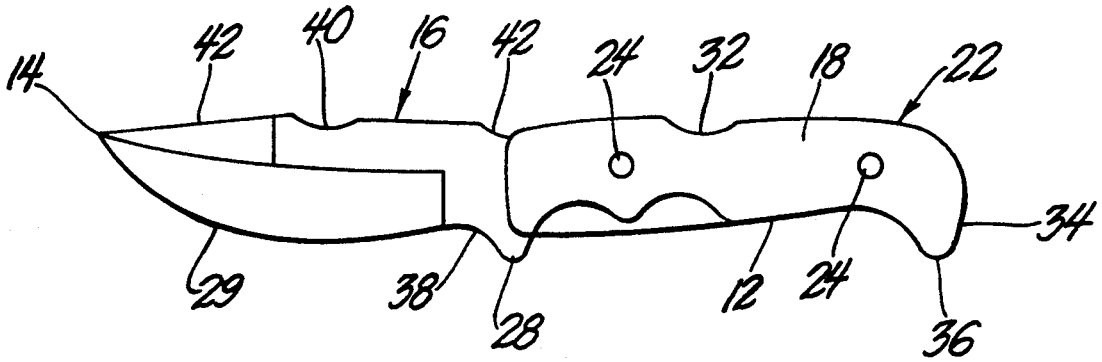
FIG. 3 is a front view of a second embodiment of this invention.
Figure 4:
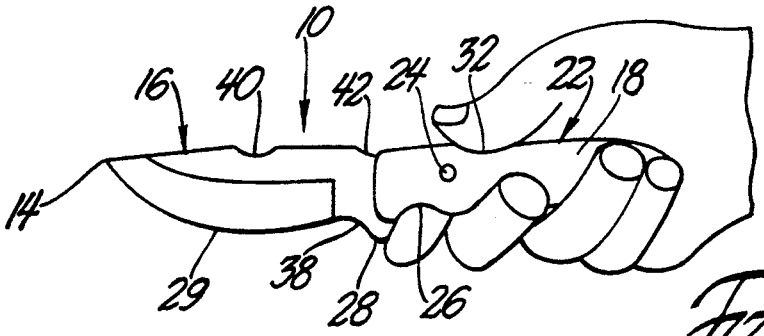
FIG. 4 is a view of the knife of FIG. 1 in a thrusting grasp.
Figure 5:
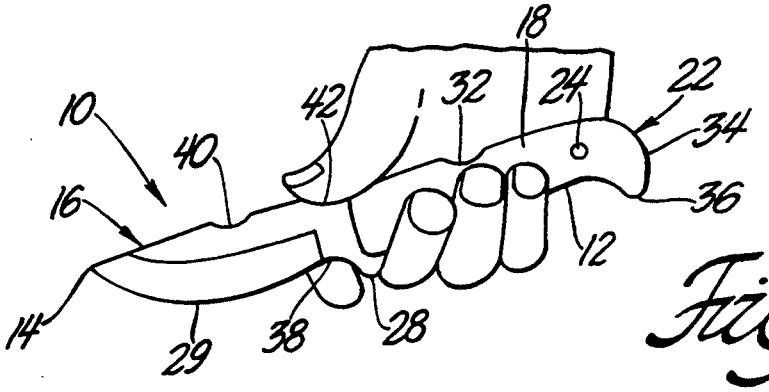
FIG. 5 is a view of the knife of FIG. 1 in a skinning grasp.
Figure 6:
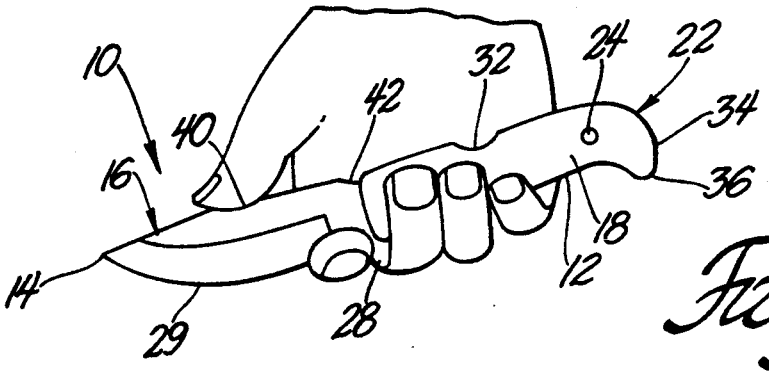
FIG. 6 is a view of the knife of FIG. 1 in a carving grasp.
Figure 7:
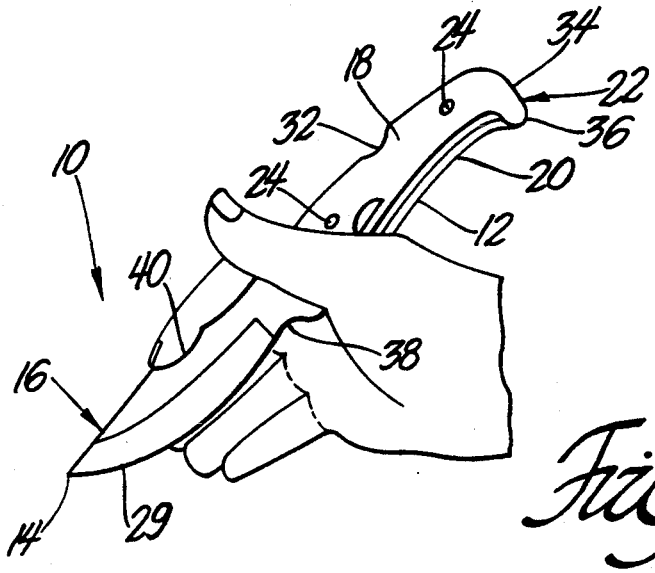
FIG. 7 is a view of the knife of FIG. 1 in a pen hold grasp.

As shown in FIG. 3, the blade 16 may have a portion 42 of the upper surface of the knife blade sharpened such a blade structure making the knife of FIGS. 1 and 2, a utility tool, suitable for use as a weapon.

The various structural features of the present knife cooperate for easy use in a variety of grips. The most basic grip is to close the fist about the handle with the index finger in the first recess 26 of the handle 22 and the remainder of the fingers between the hook 36 and the quillion 28. This is an easy grip, firm but lacking in control for many uses.

A carving grasp can be assumed by gripping the handle of the knife normally with the fingers about the handle and placing the thumb on the thrust ramp 42 at the juncture of handle 22 and blade 16. In this position, the thumb is aligned with the longitudinal axis of the blade and can be used to exert substantial force with safety since the quillion 28 protects the hand from sliding forward onto the edge 29.

The knife of the present invention allows the hand to assume a thrusting grasp by sliding the hand back towards the pommel 34 with the pommel being seated in the palm of the hand and the thumb resting in the depression 32 formed in the upper surface of the handle 22. This grip reorients the fingers of the hand with the index finger being located in the first recess 26 and the axial force and any reaction being transmitted to the palm of the hand. This provides an improved thrusting grip useful in piercing, such as in opening boxes and the like, There are certain tasks such as skinning game or shaving fine slices where close control of the edge is more important than sheer power. The present structure allows the index finger to be placed in the choil 38 and the thumb on the thrust ramp 42 above quill ion 28. In this grasp there is excellent control of the knife edge. Because the index finger is located near the edge, power is limited by safety considerations.

A second carving grip can be assumed by placing the index finger in the choil 38 and the thumb in the unsharpened notch 40. In this position the thumb can be used to exert substantial lateral force on the blade to allow cutting of harder materials such as wood and the like.

There also exist situations where a fine pen like grasp is desirable to control the point 14 of the blade 16. The present structure allows the index finger to be placed in the notch 40 on the back of the blade and the first recess 26 on the handle to be nestled in the web of the hand between the thumb and index finger. The middle finger extends along the blade's center line for additional control. The quillion 28 provides safety to the holding hand's web and prevents slippage. In this position the point 14 of the blade 16 can be used as a scribeing instrument on soft materials.

The choil 38 notch 40 and thrust ramp 42 have been shown as smooth however they can be textured or serrated when desired to provide better slip protection.

From the foregoing description it is apparent a new ergometric and useful knife structure which allows the knife to be used safely in a variety of grips has been disclosed. Various modifications and alterations will become apparent to those skilled in the art with out departing from the scope and spirit of this invention and it is understood that this invention is not limited to the illustrative embodiments set forth above.

What is claimed is:

1. An improved ergonomic knife configuration the knife comprising: a blade with a sharpened edge, the blade having an integral tang extending away from the sharpened edge, the blade having a quillion projecting from the blade near the midportion of the blade between the tang and the edge, a choil is located juxtaposed the quillion, between the quillion and the sharpened edge, the blade has an unsharpened notch formed on the upper, back surface of the blade the unsharpened notch being located forward of the handle so as to be a comfortable position for a users thumb when the users index finger is in the choil, a thrust ramp is located approximately above the quillion at the beginning of the tang; and a handle firmly attached to the tang the handle including two shaped pieces one piece being mounted on each side of the tang, to form a shaped handle suitable for gripping, the handle formed by the two pieces has a first recess located on the lower handle juxtaposed the quillion, a second recess is formed on the handle adjacent the first recess, a depression is formed on the top surface of the handle, the handle having a contoured pommel at its free end and a hook on the lower portion of the pommel to prevent slippage.

2. The knife of claim 1 where the depression is located about 1.5 to 2.5 inches behind the juncture of the blade and the handle.

3. The knife of claim 1 having a handle formed as a single piece.

* * * * *